US010062473B2

(12) United States Patent
Inoue et al.

(10) Patent No.: US 10,062,473 B2
(45) Date of Patent: Aug. 28, 2018

(54) SILVER-COATED COPPER ALLOY POWDER AND METHOD FOR PRODUCING SAME

(71) Applicant: DOWA ELECTRONICS MATERIALS CO., LTD., Tokyo (JP)

(72) Inventors: Kenichi Inoue, Okayama (JP); Kozo Ogi, Okayama (JP); Atsushi Ebara, Okayama (JP); Yuto Hiyama, Saitama (JP); Takahiro Yamada, Okayama (JP); Toshihiko Ueyama, Okayama (JP)

(73) Assignee: Dowa Electronics Materials Co., Ltd., Tokyo (JP)

( * ) Notice: Subject to any disclaimer, the term of this patent is extended or adjusted under 35 U.S.C. 154(b) by 308 days.

(21) Appl. No.: 14/372,789

(22) PCT Filed: Jan. 15, 2013

(86) PCT No.: PCT/JP2013/051019

§ 371 (c)(1),
(2) Date: Jul. 17, 2014

(87) PCT Pub. No.: WO2013/108916

PCT Pub. Date: Jul. 25, 2013

(65) Prior Publication Data

US 2014/0346413 A1 Nov. 27, 2014

(30) Foreign Application Priority Data

Jan. 17, 2012 (JP) ..... 2012-006886
May 28, 2012 (JP) ..... 2012-120360

(51) Int. Cl.
*H01B 1/22* (2006.01)
*B22F 1/02* (2006.01)
(Continued)

(52) U.S. Cl.
CPC ..... *H01B 1/22* (2013.01); *B22F 1/0011* (2013.01); *B22F 1/0074* (2013.01); *B22F 1/025* (2013.01);
(Continued)

(58) Field of Classification Search
CPC . H01B 1/00; H01B 1/02; H01B 1/026; H01B 1/22; B22F 1/02; B22F 1/025; B22F 9/08; C22C 9/04; C22C 9/06
See application file for complete search history.

(56) References Cited

U.S. PATENT DOCUMENTS 5,951,918 A * 9/1999 Kuwajima ..... H01B 1/02 174/257
7,504,199 B2 * 3/2009 Noh ..... H05K 3/185 430/313

FOREIGN PATENT DOCUMENTS

JP 0378906 A 4/1991
JP 08-311304 A 11/1996
(Continued)

OTHER PUBLICATIONS

English language machine translation of JP 03-078906A (pub 1991).*
(Continued)

*Primary Examiner* — Mark Kopec
(74) *Attorney, Agent, or Firm* — Bachman & LaPointe, PC

(57) ABSTRACT

A silver-coated copper alloy powder, which has a low volume resistivity and excellent storage stability (reliability), is produced by coating a copper alloy powder, which has a chemical composition comprising 1 to 50 wt % of at least one of nickel and zinc and the balance being copper and unavoidable impurities (preferably a copper alloy powder wherein a particle diameter ($D_{50}$ diameter) corresponding to 50% of accumulation in cumulative distribution of the
(Continued)

copper alloy powder, which is measured by a laser diffraction particle size analyzer, is 0.1 to 15 μm), with 7 to 50 wt % of a silver containing layer, preferably a layer of silver or an silver compound.

30 Claims, 2 Drawing Sheets

(51) Int. Cl.

| | |
|---|---|
| ***C22C 9/00*** | (2006.01) |
| ***C22C 9/04*** | (2006.01) |
| ***C22C 9/06*** | (2006.01) |
| ***H01B 1/02*** | (2006.01) |
| ***B22F 1/00*** | (2006.01) |
| ***C22C 1/04*** | (2006.01) |
| ***C22C 5/06*** | (2006.01) |
| *B22F 9/08* | (2006.01) |

(52) U.S. Cl.
CPC ..... *C22C 1/0425* (2013.01); *C22C 5/06* (2013.01); *C22C 9/04* (2013.01); *C22C 9/06* (2013.01); *H01B 1/026* (2013.01); *B22F 9/082* (2013.01); *Y10T 428/2991* (2015.01)

(56) References Cited

FOREIGN PATENT DOCUMENTS

| | | | |
|---|---|---|---|
| JP | 10-152630 | A | 6/1998 |
| JP | 2002-332501 | A | 11/2002 |
| JP | 2003-68139 | A | 3/2003 |
| JP | 2010-077495 | A | 4/2010 |
| JP | 2010-174311 | A | 8/2010 |
| JP | 2012-180564 | A | 9/2012 |
| WO | WO 2017170398 | A1 * | 10/2017 |

OTHER PUBLICATIONS

English language machine translation of JP 08-311304A (pub 1996).*
European Search Report for EP 13737989.7 dated Sep. 3, 2015.
Database WPI, Week 199120, Thomson Scientific, London, GB; AN 1991-143598, XP002743975.
Database WPI, Week 199706, Thomson Scientific, London, GB; AN 1997-061962, XP002743976.

* cited by examiner

SILVER-COATED COPPER ALLOY POWDER AND METHOD FOR PRODUCING SAME

TECHNICAL FIELD

The present invention relates generally to a silver-coated copper alloy powder and a method for producing the same. More specifically, the invention relates to a silver-coated copper alloy powder for use in electrically conductive pastes and so forth, and a method for producing the same.

BACKGROUND ART

Conventionally, an electrically conductive paste prepared by mixing or compounding a solvent, a resin, a dispersing agent and so forth with an electrically conductive metal powder, such as silver or copper powder, is used for forming electrodes and electric wirings of electronic parts by a printing method or the like.

However, silver powder increases the costs of the paste since it is a noble metal although it is a good electrically conductive material having a very low volume resistivity. On the other hand, the storage stability (reliability) of copper powder is inferior to that of silver powder since copper powder is easily oxidized although it is a good electrically conductive material having a low volume resistivity.

In order to solve these problems, as metal powders for use in electrically conductive pastes, there are proposed a silver-coated copper powder wherein the surface of copper powder is coated with silver (see, e.g., Japanese Patent Laid-Open Nos. 2010-174311 and 2010-077495) and a silver-coated copper alloy powder wherein the surface of a copper alloy is coated with silver (see, e.g., Japanese Patent Laid-Open Nos. 08-311304 and 10-152630).

However, in the silver-coated copper powder disclosed in Japanese Patent Laid-Open Nos. 2010-174311 and 2010-077495, if a part of the surface of copper powder is not coated with silver, the oxidation of copper powder progresses from the part, so that the storage stability (reliability) of the silver-coated copper powder is insufficient. In the silver-coated copper alloy powder disclosed in Japanese Patent Laid-Open No. 08-311304 or 10-152630, there is a problem in that it has a high volume resistivity (a low electrically conductivity), so that the storage stability (reliability) thereof is very low.

DISCLOSURE OF THE INVENTION

It is therefore an object of the present invention to eliminate the aforementioned conventional problems and to provide a silver-coated copper alloy powder which has a low volume resistivity and excellent storage stability (reliability), and a method for producing the same.

In order to accomplish the aforementioned object, the inventors have diligently studied and found that it is possible to produce a silver-coated copper alloy powder which has a low volume resistivity and excellent storage stability (reliability) if a copper alloy powder, which has a chemical composition comprising 1 to 50 wt % of at least one of nickel and zinc and the balance being copper and unavoidable impurities, is coated with 7 to 50 wt % of a silver containing layer. Thus, the inventors have made the present invention.

According to the present invention, a silver-coated copper alloy powder comprises: a copper alloy powder having a chemical composition comprising 1 to 50 wt % of at least one of nickel and zinc and the balance being copper and unavoidable impurities; and 7 to 50 wt % of a silver containing layer coating the copper alloy powder.

In this silver-coated copper alloy powder, the silver containing layer is preferably a layer of silver or a silver compound. The particle diameter ($D_{50}$ diameter) corresponding to 50% of accumulation in cumulative distribution of the copper alloy powder, which is measured by a laser diffraction particle size analyzer, is preferably 0.1 to 15 μm. The rate of increase of weight of the copper alloy powder is preferably not greater than 5% when the temperature of the copper alloy powder is increased at a rate of temperature increase of 5° C./min. from room temperature (25° C.) to 300° C. The silver-coated copper alloy powder preferably has a volume resistivity, which is not higher than 500% of an initial volume resistivity thereof, when a load of 20 kN is applied to the silver-coated copper alloy powder after it is stored under an environment of a temperature of 85° C. and a humidity of 85% for 1 week. If the silver containing layer is a layer of silver, the percentage of area of the silver containing layer occupying the surface of the silver-coated copper alloy powder with respect to that of the whole surface thereof is preferably not less than 70 area %, the percentage being calculated from results obtained by quantifying atoms on the outermost surface of the silver-coated copper alloy powder by a scanning Auger electron spectrometer.

According to the present invention, there is provided a method for producing a silver-coated copper alloy powder, the method comprising the steps of: preparing a copper alloy powder having a chemical composition comprising 1 to 50 wt % of at least one of nickel and zinc and the balance being copper and unavoidable impurities; and coating the copper alloy powder with 7 to 50 wt % of a silver containing layer.

In this method for producing a silver-coated copper alloy powder, the copper alloy powder is preferably produced by an atomizing method. The silver containing layer is preferably a layer of silver or a silver compound. The particle diameter ($D_{50}$ diameter) corresponding to 50% of accumulation in cumulative distribution of the copper alloy powder, which is measured by a laser diffraction particle size analyzer, is preferably 0.1 to 15 μm.

According to the present invention, an electrically conductive paste comprises: a solvent; a resin; and the above-described silver-coated copper alloy powder as an electrically conductive powder. According to the present invention, an electrically conductive film is formed by curing the electrically conductive paste.

According to the present invention, it is possible to provide a silver-coated copper alloy powder which has a low volume resistivity and excellent storage stability (reliability), and a method for producing the same.

BEST MODE FOR CARRYING OUT THE INVENTION

Figure 1A:
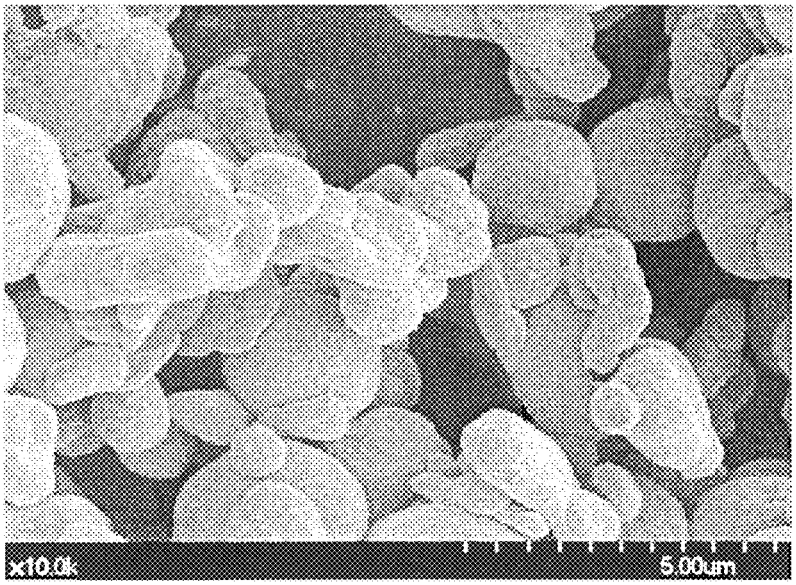
FIG. 1A is a scanning electron micrograph (SEM image) of a silver-coated copper alloy powder obtained in Example 8, when it is in an initial state.

In a preferred embodiment of a silver-coated copper alloy powder according to the present invention, a copper alloy powder, which has a chemical composition comprising 1 to 50 wt % of at least one of nickel and zinc and the balance being copper and unavoidable impurities, is coated with 7 to 50 wt % of a silver containing layer (with respect to the silver-coated copper alloy powder).

The content of at least one of nickel and zinc in the copper alloy powder is 1 to 50 wt %, preferably 3 to 45 wt %, and more preferably 5 to 40 wt %. If the content of at least one of nickel and zinc is less than 1 wt %, the copper alloy powder is not preferable since copper in the copper alloy powder is violently oxidized so that the oxidation resistance thereof is not good. On the other hand, if the content of at least one of nickel and zinc exceeds 50 wt %, the copper alloy powder is not preferable since it has a bad influence on the electrical conductivity of the copper alloy powder. The copper alloy powder may have a spherical shape or a thin-piece shape (flake shape). For example, such a flake-shaped copper alloy powder may be produced by mechanically plastic-deforming and flatting a spherical copper alloy powder by means of a ball mill or the like. With respect to the particle size of the copper alloy powder, the particle diameter ($D_{50}$ diameter) corresponding to 50% of accumulation in cumulative distribution of the copper alloy powder, which is measured by a laser diffraction particle size analyzer (by HELOS system), is preferably 0.1 to 15 μm, more preferably 0.3 to 10 μm, and most preferably 0.5 to 5 μm.

The copper alloy powder is coated with 7 to 50 wt %, preferably 8 to 45 wt % and more preferably 9 to 40 wt %, of the silver containing layer. The silver containing layer is preferably a layer of silver or a silver compound. If the silver containing layer is a layer of silver, the percentage of area of the silver containing layer occupying the surface of the silver-coated copper alloy powder with respect to that of the whole surface thereof, which is calculated from results obtained by quantifying atoms on the outermost surface of the silver-coated copper alloy powder by a scanning Auger electron spectrometer, is preferably not less than 70 area %, more preferably not less than 80 area %, and most preferably not less than 90 area %. If the percentage of area of the silver containing layer occupying the surface of the silver-coated copper alloy powder with respect to that of the whole surface thereof is less than 70 area %, the oxidation of the silver-coated copper alloy powder easily progresses, so that the storage stability (reliability) thereof is deteriorated.

In a preferred embodiment of a method for producing a silver-coated copper alloy powder according to the present invention, a copper alloy powder having a chemical composition comprising 1 to 50 wt % of at least one of nickel and zinc and the balance being copper and unavoidable impurities is coated with 7 to 50 wt % of a silver containing layer (shell) (with respect to the silver-coated copper alloy powder).

The copper alloy powder is preferably produced by a so-called atomizing method for producing a fine powder by rapidly cooling and solidifying alloy compositions, which are melted at a temperature of not lower than their melting temperatures, by causing a high-pressure gas or high-pressure water to collide with the alloy compositions while causing them to drop from the lower portion of a tundish. In particular, if the copper alloy powder is produced by a so-called water atomizing method for spraying a high-pressure water, it is possible to obtain a copper alloy powder having small particle diameters, so that it is possible to improve the electric conductivity of an electrically conductive paste due to the increase of the number of contact points between the particles when the copper alloy powder is used for preparing the electrically conductive paste.

On the surface of the copper alloy powder thus produced, a silver containing layer (a coating layer of silver or a silver compound) is formed. As a method for forming this coating layer, there may be used a method for depositing silver or a silver compound on the surface of a copper alloy powder by a reduction method utilizing a substitution reaction of copper with silver or by a reduction method using a reducing agent. For example, there may be used a method for depositing silver or a silver compound on the surface of a copper alloy powder while stirring a solution containing the copper alloy powder and the silver or silver compound in a solvent, a method for depositing silver or a silver compound on the surface of a copper alloy powder while stirring a mixed solution prepared by mixing a solution, which contains the copper alloy powder and organic substances in a solvent, with a solution containing the silver or silver compound and organic substances in a solvent, and so forth.

As the solvent, there may be used water, an organic solvent or a mixed solvent thereof. If a solvent prepared by mixing water with an organic solvent is used, it is required to use the organic solvent which is liquid at room temperature (20 to 30° C.), and the mixing ratio of water to the organic solvent may be suitably adjusted in accordance with the used organic solvent. As water used as the solvent, there may be used distilled water, ion-exchanged water, industrial water or the like unless there is the possibility that impurities are mixed therein.

As raw materials of the silver containing layer (the coating layer of silver or the silver compound), silver nitrate having a high solubility with respect to water and many organic solvents is preferably used since it is required to cause silver ions to exist in a solution. In order to carry out a silver coating reaction as uniform as possible, a silver nitrate solution, which is prepared by dissolving silver nitrate in a solvent (water, an organic solvent or a mixed solvent thereof), not solid silver nitrate, is preferably used. The amount of the used silver nitrate solution, the concentration of silver nitrate in the silver nitrate solution, and the amount of the organic solvent may be determined in accordance with the amount of the intended silver containing layer (the coating layer of silver or the silver compound).

In order to more uniformly form the silver containing layer (the coating layer of silver or the silver compound), a chelating agent may be added to the solution. As the chelating agent, there is preferably used a chelating agent having a high complex formation constant with respect to copper ions and so forth, so as to prevent the reprecipitation of copper ions which are formed as vice-generative products by a substitution reaction of silver ions with metallic copper. In particular, the chelating agent is preferably selected in view of the complex formation constant with respect to copper since the copper alloy powder serving as the core of the silver-coated copper alloy powder contains copper as a main composition element. Specifically, as the chelating agent, there may be used a chelating agent selected from the group consisting of ethylene-diamine-tetraacetic acid (EDTA), iminodiacetic acid, diethylene-triamine, triethylene-diamine, and salts thereof.

In order to stably and safely carry out the silver coating reaction, a buffer for pH may be added to the solution. As the buffer for pH, there may be used ammonium carbonate, ammonium hydrogen carbonate, ammonia water, sodium hydrogen carbonate or the like.

When the silver coating reaction is carried out, a solution containing a silver salt is preferably added to a solution in which the copper alloy powder is sufficiently dispersed by stirring the solution after the copper alloy powder is put therein before the silver salt is added thereto. The reaction temperature in this silver coating reaction may be a temperature at which the solidification and evaporation of the reaction solution are not caused. The reaction temperature is set to be preferably 20 to 80° C., more preferably 25 to 75° C., and most preferably 30 to 70° C. The reaction time may be set in the range of from 1 minute to 5 hours although it varies in accordance with the amount of the coating silver or silver compound and the reaction temperature.

Examples of a silver-coated copper alloy powder and a method for producing the same according to the present invention will be described below in detail.

EXAMPLE 1

A molten metal obtained by heating 7.2 kg of copper and 0.8 kg of nickel was rapidly cooled and solidified by spraying high-pressure water thereon while the molten metal is caused to drop from the lower portion of a tundish. An alloy powder thus obtained was filtered, washed with water, dried and broken to obtain a copper alloy powder (copper-nickel alloy powder).

Then, 61.9 g of EDTA-2Na dihydrate and 61.9 g of ammonium carbonate were dissolved in 720 g of pure water to prepare a solution (solution 1), and a solution obtained by dissolving 87.7 g of silver nitrate in 271 g of pure water was added to a solution, which was obtained by dissolving 263.2 g of EDTA-2Na dihydrate and 526.4 g of ammonium carbonate in 2097 g of pure water, to prepare a solution (solution 2).

Then, in an atmosphere of nitrogen, 130 g of the obtained copper-nickel alloy powder was added to the solution 1, and the temperature of the solution was increased to 35° C. while the solution was stirred. After the solution 2 was added to the solution in which the copper-nickel alloy powder was dispersed, the solution was stirred for 1 hour. Thereafter, the solution was filtered, washed with water, and dried to obtain a copper-nickel alloy powder coated with silver (a silver-coated copper alloy powder).

With respect to the silver-coated copper alloy powder thus obtained, the composition of the powder, the amount of coating silver therein, the mean particle size thereof and the resistance of pressed powder thereof were derived, and the storage stability (reliability) of the silver-coated copper alloy powder was evaluated. The composition and mean particle size of the copper alloy powder before being coated with silver were derived, and the high-temperature stability of the copper alloy powder before being coated with silver was evaluated.

The content of each of copper and nickel in the copper alloy powder before being coated with silver was derived as follows. That is, after the copper alloy powder (about 2.5 g) before being coated with silver was spread in a ring of vinyl chloride (having an inside diameter of 3.2 cm×a thickness of 4 mm), a load of 100 kN was applied thereto by means of a tablet type compress ion molding machine (Model Number BRE-50 produced by Maekawa Testing Machine MFG Co., LTD.) to prepare a pellet of the copper alloy before being coated with silver. The pellet thus prepared was put in a sample holder (having an opening size of 3.0 cm) to be set at a measuring position in an X-ray fluorescence spectrometer (RIX2000 produced by Rigaku Corporation). The content of each of copper and nickel in the copper alloy powder before being coated with silver was automatically calculated, by a software attached to the spectrometer, on the basis of the results of measurement at an X-ray output of 50 kV and 50 mA in a measuring atmosphere of a reduced pressure (of 8.0 Pa). As a result, the content of copper in the copper alloy powder before being coated with silver was 90.1 wt %, and the content of nickel therein was 9.9 wt %.

As the mean particle size of the copper alloy powder before being coated with silver, the particle diameter ($D_{50}$ diameter) corresponding to 50% of accumulation in cumulative distribution of the copper alloy powder was measured by a laser diffraction particle size analyzer. As a result, the particle diameter ($D_{50}$ diameter) was 1.7 μm.

The high-temperature stability of the copper alloy powder before being coated with silver was evaluated as follows. That is, a thermo gravimetry differential thermal analyzer (EXATER TG/DTA 6300 produced by SII Nanotechnology Inc.) was used for deriving a difference between the weight of the copper alloy powder, which was measured after the temperature thereof was increased at a rate of temperature increase of 5° C./min. from room temperature (25° C.) to 300° C. in the atmosphere, and the weight of the copper alloy powder which was measured before the heating. Then, the analyzer was used for deriving a percentage (%) of increase of the difference (the weight of the copper alloy powder increased by the heating) with respect to the weight of the copper alloy powder before the heating. The high-temperature stability of the copper alloy powder (against oxidation) in the atmosphere was evaluated on the basis of the percentage (%) of increase assuming that all of the weight of the copper alloy powder increased by the heating was the weight of the copper alloy powder increased by oxidation. As a result, the rate of increase of the weight of the copper alloy powder was 2.6%.

These results are shown in Table 1.

TABLE 1

| | Copper Alloy (or Copper) Powder | | | | | | | Rate |
|---|---|---|---|---|---|---|---|---|
| | Amount of Materials (kg) | | | Composition (wt %) | | | Mean Particle Size | of increase of weight |
| | Cu | Ni | Zn | Cu | Ni | Zn | (μm) | (%) |
| Ex. 1-3 | 7.2 | 0.8 | 0.0 | 90.1 | 9.9 | — | 1.7 | 2.6 |
| Comp. 1-3 | | | | | | | | |
| Ex. 4 | 5.6 | 2.4 | 0.0 | 70.4 | 29.5 | — | 1.7 | 0.3 |
| Ex. 5 | 7.6 | 0.0 | 0.4 | 95.3 | — | 4.7 | 2.1 | 4.2 |
| Ex. 6-7 | 7.2 | 0.0 | 0.8 | 91.9 | — | 7.1 | 2.2 | 2.2 |
| Ex. 8 | 5.6 | 0.0 | 2.4 | 72.8 | — | 27.1 | 1.7 | 0.1 |
| Ex. 9 | 4.0 | 0.0 | 4.0 | 67.5 | — | 32.2 | 1.8 | 0.3 |
| Ex. 10 | 6.4 | 0.8 | 0.8 | 84.5 | 10.8 | 4.3 | 1.9 | 1.7 |
| Ex. 11 | 7.6 | 0.0 | 0.4 | 95.5 | — | 4.5 | 4.7 | 2.4 |
| Ex. 12 | 7.6 | 0.0 | 0.4 | 95.5 | — | 4.5 | 6.1 | 2.9 |
| Comp. 4 | 8.0 | 0.0 | 0.0 | 100 | — | — | 2.0 | 8.8 |
| Comp. 5 | — | — | — | 100 | — | — | 5.7 | 3.3 |

The content of each of copper and nickel in the silver-coated copper alloy powder, and the amount of the coating silver of the silver-coated copper alloy powder were derived by the same method as that of the content of each of copper and nickel in the copper alloy powder before being coated with silver. As a result, the content of copper in the silver-coated copper alloy powder was 58.2 wt %, the content of nickel therein was 6.6 wt %, and the amount of the coating silver therein was 34.9 wt %.

As the mean particle size of the silver-coated copper alloy powder, the particle diameter ($D_{50}$ diameter) corresponding to 50% of accumulation in cumulative distribution of the silver-coated copper alloy powder was measured by a laser diffraction particle size analyzer. As a result, the particle diameter ($D_{50}$ diameter) was 4.5 μm.

As the resistance of the pressed powder of the silver-coated copper alloy powder, the volume resistivity (initial volume resistivity) (of the pressed powder) was measured when a load of 20 kN was applied thereto by starting pressurization after 6.5 g of the silver-coated copper alloy powder was filled in the measuring vessel of a pressed powder resistance measuring system (MCP-PD51 produced by Mitsubishi Analytic Co., Ltd.). As a result, the initial volume resistivity of the silver-coated copper alloy powder was $6.7\times10^{-5}\Omega\cdot$cm.

The storage stability (reliability) of the silver-coated copper alloy powder was evaluated by Rate (%) of Variation of Volume Resistivity={(Volume Resistivity after being stored for 1 week)−(Initial Volume Resistivity)}×100/(Initial Volume Resistivity). The volume resistivity (Volume Resistivity after being stored for 1 week) was measured when a load of 20 kN was applied thereto by starting pressurization after 6.5 g of the silver-coated copper alloy powder, which was stored for 1 week while being uniformly spread on a petri dish in a chamber held at a constant temperature (85° C.) and a constant humidity (85%), was filled in the measuring vessel of the pressed powder resistance measuring system (MCP-PD51 produced by Mitsubishi Analytic Co., Ltd.). As a result, the rate of variability of the volume resistivity of the silver-coated copper alloy powder after being stored for 1 week was 226%. The rate of variability of the volume resistivity of the silver-coated copper alloy powder after being stored for 2 weeks was similarly evaluated to be 304%.

These results are shown in Tables 2 and 3.

TABLE 2

| | Silver-Coated Copper Alloy (or Copper) Powder | | | | |
|---|---|---|---|---|---|
| | Composition (wt %) | | | | Mean Particle Size |
| | Cu | Ni | Zn | Ag | (μm) |
| Ex. 1 | 58.2 | 6.6 | — | 34.9 | 4.5 |
| Ex. 2 | 69.6 | 7.9 | — | 22.4 | 2.9 |
| Ex. 3 | 47.5 | 5.6 | — | 46.8 | 4.9 |
| Ex. 4 | 45.9 | 19.7 | — | 34.3 | 5.5 |
| Ex. 5 | 63.8 | — | 2.7 | 33.3 | 6.6 |
| Ex. 6 | 66.8 | — | 4.9 | 27.6 | 4.6 |
| Ex. 7 | 83.0 | — | 5.7 | 11.0 | 3.3 |
| Ex. 8 | 49.3 | — | 13.4 | 36.9 | 5.6 |
| Ex. 9 | 46.8 | — | 17.4 | 35.7 | 4.7 |
| Ex. 10 | 56.0 | 7.0 | 2.2 | 34.7 | 6.1 |
| Ex. 11 | 79.9 | — | 3.5 | 16.6 | 5.6 |
| Ex. 12 | 77.5 | — | 3.3 | 19.2 | 7.2 |
| Comp. 1 | 90.1 | 9.9 | — | 0 | 1.7 |
| Comp. 2 | 87.9 | 9.9 | — | 2.2 | 1.7 |
| Comp. 3 | 85.0 | 9.5 | — | 5.5 | 1.8 |
| Comp. 4 | 72.9 | — | — | 27.0 | 4.7 |
| Comp. 5 | 80.4 | — | — | 19.6 | 9.1 |

TABLE 3

| | Silver-Coated Copper Alloy (or Copper) Powder | | |
|---|---|---|---|
| | Initial Volume Resistivity | Rate of Variability of Volume Resistivity (%) | |
| | (Ω · cm) | After 1 week | After 2 weeks |
| Ex. 1 | $6.7\times10^{-5}$ | 226 | 304 |
| Ex. 2 | $6.5\times10^{-5}$ | 147 | 202 |
| Ex. 3 | $4.6\times10^{-5}$ | 19 | 14 |
| Ex. 4 | $8.3\times10^{-5}$ | 180 | 412 |
| Ex. 5 | $2.4\times10^{-5}$ | 10 | 4 |
| Ex. 6 | $3.3\times10^{-5}$ | 131 | 78 |
| Ex. 7 | $3.8\times10^{-5}$ | 4 | 24 |
| Ex. 8 | $3.9\times10^{-5}$ | 6 | -17 |
| Ex. 9 | $3.5\times10^{-5}$ | 37 | 50 |
| Ex. 10 | $4.0\times10^{-5}$ | 35 | 44 |
| Ex. 11 | $2.8\times10^{-5}$ | −27 | −5 |
| Ex. 12 | $3.0\times10^{-5}$ | −16 | −10 |
| Comp. 1 | $3.3\times10^{4}$ | — | — |
| Comp. 2 | $70.0\times10^{-5}$ | 419526798 | 646498597 |
| Comp. 3 | $18.0\times10^{-5}$ | 179844 | 318314 |
| Comp. 4 | $2.9\times10^{-5}$ | 912 | 1709 |
| Comp. 5 | $8.4\times10^{-5}$ | 38400900801 | 24173914178 |

Then, 65.1 g of the obtained silver-coated copper alloy powder, 27.9 g of flake-shaped silver powder (FA-D-6 produced by DOWA Electronics Materials Co., Ltd., Mean Particle Size ($D_{50}$ Diameter) of 8.3 μm), 8.2 g of bisphenol F epoxy resin (ADEKA Resin EP-4901E produced by ADEKA Corporation) serving as a thermosetting resin, 0.41 g of boron trifluoride monoethyl amine, 2.5 g of butyl carbitol acetate serving as a solvent, and 0.1 g of oleic acid were mixed by a kneading/degassing machine. Then, the mixture thus obtained was caused to pass through a triple roll mill five times to be uniformly dispersed to obtain an electrically conductive paste.

After the electrically conductive paste was printed on an aluminum substrate (in a pattern having a line width of 500 μm and a line length of 37.5 mm) by the screen printing method, the paste was calcinated at 200° C. for 40 minutes in the atmosphere to be cured to form a conductive film. The volume resistivity of the conductive film thus obtained was calculated, and the storage stability (reliability) thereof was evaluated.

The volume resistivity of the conductive film was calculated from Volume Resistivity (Ω·cm)=Line Resistance (Ω)×Thickness (cm)×Line Width (cm)/Line Length (cm). The line resistance of the obtained conductive film was measured by a two-terminal type resistivity meter (3540 milli-orm HiTESTER produced by Hioki E.E. Corporation) based on the two-terminal method. The thickness of the conductive film was measured by a surface roughness/contour measuring instrument (SARFCOM 1500DX produced by Tokyo Seimitsu Co., Ltd.). As a result, the volume resistivity (the initial volume resistivity) of the conductive film was $14.5\times10^{-5}\Omega\cdot$cm.

The storage stability (reliability) of the conductive film was evaluated by Rate (%) of Variability of Volume Resistivity={(Volume Resistivity after being stored for 1 week)−(Initial Volume Resistivity)}×100/(Initial Volume Resistivity). The volume resistivity (Volume Resistivity after being stored for 1 week) was derived after the conductive film was stored for 1 week in a chamber held at a constant temperature (85° C.) and a constant humidity (85%). As a result, the rate of variability of the volume resistivity of the conductive film after being stored for 1 week was −3%. The rate of variability of the volume resistivity of the conductive film after being stored for 2 weeks was similarly evaluated to be −9%.

These results are shown in Table 4.

TABLE 4

| | Conductive Film | | |
|---|---|---|---|
| | Initial Volume Resistivity | Rate of Variability of Volume Resistivity (%) | |
| | (Ω · cm) | After 1 week | After 2 weeks |
| Ex. 1 | $14.5 \times 10^{-5}$ | −3 | −9 |
| Ex. 2 | $12.1 \times 10^{-5}$ | 0 | −1 |
| Ex. 3 | $13.6 \times 10^{-5}$ | −4 | −4 |
| Ex. 4 | $15.5 \times 10^{-5}$ | −1 | −5 |
| Ex. 5 | $6.2 \times 10^{-5}$ | −8 | −7 |
| Ex. 6 | $10.2 \times 10^{-5}$ | −6 | −2 |
| Ex. 7 | $7.9 \times 10^{-5}$ | 1 | 1 |
| Ex. 8 | $7.1 \times 10^{-5}$ | 0 | 0 |
| Ex. 9 | $11.8 \times 10^{-5}$ | −7 | −6 |
| Ex. 10 | $8.1 \times 10^{-5}$ | −3 | −5 |
| Ex. 11 | $5.1 \times 10^{-5}$ | 2 | 2 |
| Ex. 12 | $6.5 \times 10^{-5}$ | 4 | 4 |
| Comp. 1 | $2146.1 \times 10^{-5}$ | 974 | — |
| Comp. 2 | $79.5 \times 10^{-5}$ | 8 | 15 |
| Comp. 3 | $26.0 \times 10^{-5}$ | 4 | 8 |
| Comp. 4 | $13.6 \times 10^{-5}$ | 11 | 43 |
| Comp. 5 | $144.1 \times 10^{-5}$ | 1 | −4 |

EXAMPLE 2

The same copper alloy powder (copper-nickel alloy powder) as that in Example 1 was used for obtaining a copper-nickel alloy powder coated with silver (a silver-coated copper alloy powder) by the same method as that in Example 1, except that a solution prepared by dissolving 61.9 g of EDTA-2Na dihydrate and 61.9 g of ammonium carbonate in 720 g of pure water was used as the solution 1 and that a solution prepared by adding a solution, which was prepared by dissolving 51.2 g of silver nitrate in 222 g of pure water, to a solution, which was obtained by dissolving 307.1 g of EDTA-2Na dihydrate and 153.5 g of ammonium carbonate in 1223 g of pure water, was used as the solution 2.

With respect to the silver-coated copper alloy powder thus obtained, the composition of the powder, the amount of coating silver therein, the mean particle size thereof and the resistance of pressed powder thereof were derived by the same methods as those in Example 1, and the storage stability (reliability) of the powder was evaluated by the same method as that in Example 1. As a result, the content of copper in the silver-coated copper alloy powder was 69.6 wt %, the content of nickel therein was 7.9 wt %, and the amount of coating silver therein was 22.4 wt %. The mean particle size of the silver-coated copper alloy powder was 2.9 μm. The initial volume resistivity of the silver-coated copper alloy powder was $6.5\times10^{-5}$Ω·cm. The rate of variability of the volume resistivity after being stored for 1 week was 147%, and the rate of variability of the volume resistivity after being stored for 2 weeks was 202%.

The obtained silver-coated copper alloy powder was used for preparing a conductive film by the same method as that in Example 1. With respect to the conductive film thus obtained, the calculation of the volume resistivity thereof and the evaluation of the storage stability (reliability) thereof were carried out by the same methods as those in Example 1. As a result, the volume resistivity (initial volume resistivity) of the conductive film was $12.1\times10^{-5}$Ω·cm. The rate of variability of the volume resistivity of the conductive film after being stored for 1 week was 0%, and the rate of variability of the volume resistivity of the conductive film after being stored for 2 weeks was −1%.

These results are shown in Tables 1 through 4.

EXAMPLE 3

The same copper alloy powder (copper-nickel alloy powder) as that in Example 1 was used for obtaining a copper-nickel alloy powder coated with silver (a silver-coated copper alloy powder) by the same method as that in Example 1, except that a solution prepared by dissolving 19 g of EDTA-2Na dihydrate and 19 g of ammonium carbonate in 222 g of pure water was used as the solution 1 and that a solution prepared by adding a solution, which was obtained by dissolving 42 g of silver nitrate in 100 g of pure water, to a solution, which was obtained by dissolving 252 g of EDTA-2Na dihydrate and 126 g of ammonium carbonate in 1004 g of pure water, was used as the solution 2.

With respect to the silver-coated copper alloy powder thus obtained, the composition of the powder, the amount of coating silver therein, the mean particle size thereof and the resistance of pressed powder thereof were derived by the same methods as those in Example 1, and the storage stability (reliability) of the powder was evaluated by the same method as that in Example 1. As a result, the content of copper in the silver-coated copper alloy powder was 47.5 wt %, the content of nickel therein was 5.6 wt %, and the amount of coating silver therein was 46.8 wt %. The mean particle size of the silver-coated copper alloy powder was 4.9 μm. The initial volume resistivity of the silver-coated copper alloy powder was $4.6\times10^{-5}$Ω·cm. The rate of variability of the volume resistivity after being stored for 1 week was 19%, and the rate of variability of the volume resistivity after being stored for 2 weeks was 14%.

The obtained silver-coated copper alloy powder was used for preparing a conductive film by the same method as that in Example 1. With respect to the conductive film thus obtained, the calculation of the volume resistivity thereof and the evaluation of the storage stability (reliability) thereof were carried out by the same methods as those in Example 1. As a result, the volume resistivity (initial volume resistivity) of the conductive film was $13.6\times10^{-5}$Ω·cm. The rate of variability of the volume resistivity of the conductive film after being stored for 1 week was −4%, and the rate of variability of the volume resistivity of the conductive film after being stored for 2 weeks was −4%.

These results are shown in Tables 1 through 4.

EXAMPLE 4

A copper alloy powder (copper-nickel alloy powder) was obtained by the same method as that in Example 1, except that 5.6 kg of copper and 2.4 kg of nickel were used in place of 7.2 kg of copper and 0.8 kg of nickel.

With respect to the copper alloy powder thus obtained, the composition of the powder and the mean particle size thereof were derived by the same methods as those in Example 1, and the high-temperature stability thereof was evaluated by the same method as that in Example 1. As a result, the content of copper in the copper alloy powder was 70.4 wt %, and the content of nickel therein was 29.5 wt %. The mean particle size of the copper alloy powder was 1.7 μm. The rate of increase of the weight of the copper alloy powder was 0.3%.

The obtained copper alloy powder (copper-nickel alloy powder) was used for preparing a copper-nickel alloy powder coated with silver (a silver-coated copper alloy powder) by the same method as that in Example 1.

With respect to the silver-coated copper alloy powder thus obtained, the composition of the powder, the amount of coating silver therein, the mean particle size thereof and the resistance of pressed powder thereof were derived by the same methods as those in Example 1, and the storage stability (reliability) of the powder was evaluated by the same method as that in Example 1. As a result, the content of copper in the silver-coated copper alloy powder was 45.9 wt %, the content of nickel therein was 19.7 wt %, and the amount of coating silver therein was 34.3 wt %. The mean particle size of the silver-coated copper alloy powder was 5.5 μm. The initial volume resistivity of the silver-coated copper alloy powder was $8.3\times10^{-5}\Omega\cdot$cm. The rate of variability of the volume resistivity after being stored for 1 week was 180%, and the rate of variability of the volume resistivity after being stored for 2 weeks was 412%.

The obtained silver-coated copper alloy powder was used for preparing a conductive film by the same method as that in Example 1. With respect to the conductive film thus obtained, the calculation of the volume resistivity thereof and the evaluation of the storage stability (reliability) thereof were carried out by the same methods as those in Example 1. As a result, the volume resistivity (initial volume resistivity) of the conductive film was $15.5\times10^{-5}\Omega\cdot$cm. The rate of variability of the volume resistivity of the conductive film after being stored for 1 week was −1%, and the rate of variability of the volume resistivity of the conductive film after being stored for 2 weeks was −5%.

These results are shown in Tables 1 through 4.

EXAMPLE 5

A copper alloy powder (copper-zinc alloy powder) was obtained by the same method as that in Example 1, except that 7.6 kg of copper and 0.4 kg of zinc were used in place of 7.2 kg of copper and 0.8 kg of nickel.

With respect to the copper alloy powder thus obtained, the composition of the powder and the mean particle size thereof were derived by the same methods as those in Example 1, and the high-temperature stability thereof was evaluated by the same method as that in Example 1. Furthermore, the content of zinc in the copper alloy powder was calculated by the same method as the method for calculating the content of each of copper and nickel in the copper alloy powder in Example 1. As a result, the content of copper in the copper alloy powder was 95.3 wt %, and the content of zinc therein was 4.7 wt %. The mean particle size of the copper alloy powder was 2.1 μm. The rate of increase of the weight of the copper alloy powder was 4.2%.

The obtained copper alloy powder (copper-zinc alloy powder) was used for preparing a copper-zinc alloy powder coated with silver (a silver-coated copper alloy powder) by the same method as that in Example 1.

With respect to the silver-coated copper alloy powder thus obtained, the composition of the powder, the amount of coating silver therein, the mean particle size thereof and the resistance of pressed powder thereof were derived by the same methods as those in Example 1, and the storage stability (reliability) of the powder was evaluated by the same method as that in Example 1. Furthermore, the content of zinc in the silver-coated copper alloy powder was calculated by the same method as the method for calculating the content of each of copper and nickel in the silver-coated copper alloy powder in Example 1. As a result, the content of copper in the silver-coated copper alloy powder was 63.8 wt %, the content of zinc therein was 2.7 wt %, and the amount of coating silver therein was 33.3 wt %. The mean particle size of the silver-coated copper alloy powder was 6.6 μm. The initial volume resistivity of the silver-coated copper alloy powder was $2.4\times10^{-5}\Omega\cdot$cm. The rate of variability of the volume resistivity after being stored for 1 week was 10%, and the rate of variability of the volume resistivity after being stored for 2 weeks was 4%.

The obtained silver-coated copper alloy powder was used for preparing a conductive film by the same method as that in Example 1. With respect to the conductive film thus obtained, the calculation of the volume resistivity thereof and the evaluation of the storage stability (reliability) thereof were carried out by the same methods as those in Example 1. As a result, the volume resistivity (initial volume resistivity) of the conductive film was $6.2\times10^{-5}\Omega\cdot$cm. The rate of variability of the volume resistivity of the conductive film after being stored for 1 week was −8%, and the rate of variability of the volume resistivity of the conductive film after being stored for 2 weeks was −7%.

These results are shown in Tables 1 through 4.

EXAMPLE 6

A copper alloy powder (copper-zinc alloy powder) was obtained by the same method as that in Example 1, except that 0.8 kg of zinc was used in place of 0.8 kg of nickel.

With respect to the copper alloy powder thus obtained, the composition of the powder and the mean particle size thereof were derived by the same methods as those in Example 1, and the high-temperature stability thereof was evaluated by the same method as that in Example 1. Furthermore, the content of zinc in the copper alloy powder was calculated by the same method as the method for calculating the content of each of copper and nickel in the copper alloy powder in Example 1. As a result, the content of copper in the copper alloy powder was 91.9 wt %, and the content of zinc therein was 7.1 wt %. The mean particle size of the copper alloy powder was 2.2 μm. The rate of increase of the weight of the copper alloy powder was 2.2%.

The obtained copper alloy powder (copper-zinc alloy powder) was used for preparing a copper-nickel alloy powder coated with silver (a silver-coated copper alloy powder) by the same method as that in Example 1.

With respect to the silver-coated copper alloy powder thus obtained, the composition of the powder, the amount of coating silver therein, the mean particle size thereof and the resistance of pressed powder thereof were derived by the same methods as those in Example 1, and the storage stability (reliability) of the powder was evaluated by the same method as that in Example 1. Furthermore, the content of zinc in the silver-coated copper alloy powder was calculated by the same method as the method for calculating the content of each of copper and nickel in the silver-coated copper alloy powder in Example 1. As a result, the content of copper in the silver-coated copper alloy powder was 66.8 wt %, the content of zinc therein was 4.9 wt %, and the amount of coating silver therein was 27.6 wt %. The mean particle size of the silver-coated copper alloy powder was 4.6 μm. The initial volume resistivity of the silver-coated copper alloy powder was $3.3\times10^{-5}\Omega\cdot$cm. The rate of variability of the volume resistivity after being stored for 1 week was 131%, and the rate of variability of the volume resistivity after being stored for 2 weeks was 78%.

The obtained silver-coated copper alloy powder was used for preparing a conductive film by the same method as that in Example 1. With respect to the conductive film thus obtained, the calculation of the volume resistivity thereof and the evaluation of the storage stability (reliability) thereof were carried out by the same methods as those in Example 1. As a result, the volume resistivity (initial volume resistivity) of the conductive film was $10.2\times10^{-5}\Omega\cdot$cm. The rate of variability of the volume resistivity of the conductive film after being stored for 1 week was −6%, and the rate of variability of the volume resistivity of the conductive film after being stored for 2 weeks was −2%.

These results are shown in Tables 1 through 4.

EXAMPLE 7

The same copper alloy powder (copper-zinc alloy powder) as that in Example 6 was used for obtaining a copper-zinc alloy powder coated with silver (a silver-coated copper alloy powder) by the same method as that in Example 1, except that a solution prepared by dissolving 61.9 g of EDTA-2Na dihydrate and 61.9 g of ammonium carbonate in 720 g of pure water was used as the solution 1 and that a solution prepared by adding a solution, which was obtained by dissolving 22.9 g of silver nitrate in 70 g of pure water, to a solution, which was obtained by dissolving 136.5 g of EDTA-2Na dihydrate and 68.2 g of ammonium carbonate in 544 g of pure water, was used as the solution 2.

With respect to the silver-coated copper alloy powder thus obtained, the composition of the powder, the amount of coating silver therein, the mean particle size thereof and the resistance of pressed powder thereof were derived by the same methods as those in Example 1, and the storage stability (reliability) of the powder was evaluated by the same method as that in Example 1. As a result, the content of copper in the silver-coated copper alloy powder was 83.0 wt %, the content of zinc therein was 5.7 wt %, and the amount of coating silver therein was 11.0 wt %. The mean particle size of the silver-coated copper alloy powder was 3.3 μm. The initial volume resistivity of the silver-coated copper alloy powder was $3.8\times10^{-5}\Omega\cdot$cm. The rate of variability of the volume resistivity after being stored for 1 week was 4%, and the rate of variability of the volume resistivity after being stored for 2 weeks was 24%.

Furthermore, in order to examine the composition of the outermost surface (at an analyzed depth of a few nanometers) of the obtained silver-coated copper alloy powder, the outermost surface was evaluated by the scanning Auger electron spectroscopy. In this evaluation, a scanning Auger electron spectrometer (JAMP-7800 produced by JEOL Ltd.) was used for measuring the energy distribution of electrons at an accelerating voltage of 10 kV and a current value of $1\times10^{-7}$ A in a measuring range of 100 μmϕ to carry out the semi-quantitative analysis of each of Ag, Cu, Zn and Ni atoms by relative sensitivity factors attached to the spectrometer. On the basis of the analyzed value of each of the atoms obtained by this semi-quantitative analysis, the percentage (silver covering rate) (area %) of the silver layer occupying the surface of the silver-coated copper alloy powder with respect to that of the whole surface thereof was calculated from Silver Covering Rate (area %)=Analyzed Value of Ag/(Analyzed Value of Ag+Analyzed Value of Cu+Analyzed Value of Zn+Analyzed Value of Ni)×100). As a result, the percentage (silver covering rate) was 73 area %.

The obtained silver-coated copper alloy powder was used for preparing a conductive film by the same method as that in Example 1. With respect to the conductive film thus obtained, the calculation of the volume resistivity thereof and the evaluation of the storage stability (reliability) thereof were carried out by the same methods as those in Example 1. As a result, the volume resistivity (initial volume resistivity) of the conductive film was $7.9\times10^{-5}\Omega\cdot$cm. The rate of variability of the volume resistivity of the conductive film after being stored for 1 week was 1%, and the rate of variability of the volume resistivity of the conductive film after being stored for 2 weeks was 1%.

These results are shown in Tables 1 through 4.

EXAMPLE 8

A copper alloy powder (copper-zinc alloy powder) was obtained by the same method as that in Example 1, except that 5.6 kg of copper and 2.4 kg of zinc were used in place of 7.2 kg of copper and 0.8 kg of nickel.

With respect to the copper alloy powder thus obtained, the composition of the powder and the mean particle size thereof were derived by the same methods as those in Example 1, and the high-temperature stability thereof was evaluated by the same method as that in Example 1. Furthermore, the content of zinc in the copper alloy powder was calculated by the same method as the method for calculating the content of each of copper and nickel in the copper alloy powder in Example 1. As a result, the content of copper in the copper alloy powder was 72.8 wt %, and the content of zinc therein was 27.1 wt %. The mean particle size of the copper alloy powder was 1.7 μm. The rate of increase of the weight of the copper alloy powder was 0.1%.

The obtained copper alloy powder (copper-zinc alloy powder) was used for preparing a copper-zinc alloy powder coated with silver (a silver-coated copper alloy powder) by the same method as that in Example 1.

With respect to the silver-coated copper alloy powder thus obtained, the composition of the powder, the amount of coating silver therein, the mean particle size thereof and the resistance of pressed powder thereof were derived by the same methods as those in Example 1, and the storage stability (reliability) of the powder was evaluated by the same method as that in Example 1. Furthermore, the content of zinc in the silver-coated copper alloy powder was calculated by the same method as the method for calculating the content of each of copper and nickel in the silver-coated copper alloy powder in Example 1. As a result, the content of copper in the silver-coated copper alloy powder was 49.3 wt %, the content of zinc therein was 13.4 wt %, and the amount of coating silver therein was 36.9 wt %. The mean particle size of the silver-coated copper alloy powder was 5.6 μm. The initial volume resistivity of the silver-coated copper alloy powder was $3.9\times10^{-5}\Omega\cdot$cm. The rate of variability of the volume resistivity after being stored for 1 week was 6%, and the rate of variability of the volume resistivity after being stored for 2 weeks was −17%.

The obtained silver-coated copper alloy powder was used for preparing a conductive film by the same method as that in Example 1. With respect to the conductive film thus obtained, the calculation of the volume resistivity thereof and the evaluation of the storage stability (reliability) thereof were carried out by the same methods as those in Example 1. As a result, the volume resistivity (initial volume resistivity) of the conductive film was $7.1\times10^{-5}\Omega\cdot$cm. The rate of variability of the volume resistivity of the conductive film after being stored for 1 week was 0%, and the rate of variability of the volume resistivity of the conductive film after being stored for 2 weeks was 0%.

Figure 1B:
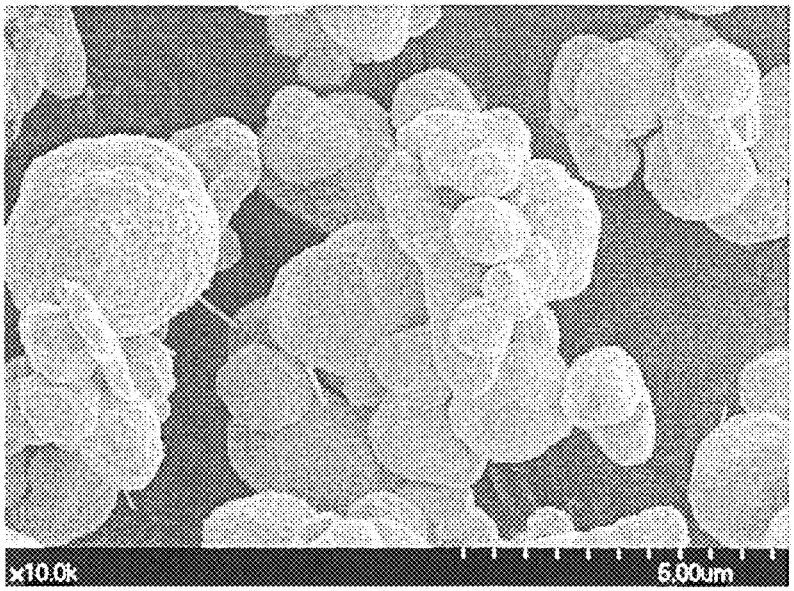
FIG. 1B is a SEM image of the silver-coated copper alloy powder obtained in Example 8, after it is stored under an environment of a temperature 85° C. and a humidity of 85% for 1 week.

These results are shown in Tables 1 through 4. FIGS. 1A and 1B show the SEM image of the silver-coated copper alloy powder obtained in this example when it was in the initial state, and the SEM image of the silver-coated copper alloy powder obtained in this example after it was stored for 1 week, respectively.

EXAMPLE 9

A copper alloy powder (copper-zinc alloy powder) was obtained by the same method as that in Example 1, except that 4.0 kg of copper and 4.0 kg of zinc were used in place of 7.2 kg of copper and 0.8 kg of nickel.

With respect to the copper alloy powder thus obtained, the composition of the powder and the mean particle size thereof were derived by the same methods as those in Example 1, and the high-temperature stability thereof was evaluated by the same method as that in Example 1. Furthermore, the content of zinc in the copper alloy powder was calculated by the same method as the method for calculating the content of each of copper and nickel in the copper alloy powder in Example 1. As a result, the content of copper in the copper alloy powder was 67.5 wt %, and the content of zinc therein was 32.2 wt %. The mean particle size of the copper alloy powder was 1.8 μm. The rate of increase of the weight of the copper alloy powder was 0.3%.

The obtained copper alloy powder (copper-zinc alloy powder) was used for preparing a copper-zinc alloy powder coated with silver (a silver-coated copper alloy powder) by the same method as that in Example 1.

With respect to the silver-coated copper alloy powder thus obtained, the composition of the powder, the amount of coating silver therein, the mean particle size thereof and the resistance of pressed powder thereof were derived by the same methods as those in Example 1, and the storage stability (reliability) of the powder was evaluated by the same method as that in Example 1. Furthermore, the content of zinc in the silver-coated copper alloy powder was calculated by the same method as the method for calculating the content of each of copper and nickel in the silver-coated copper alloy powder in Example 1. As a result, the content of copper in the silver-coated copper alloy powder was 46.8 wt %, the content of zinc therein was 17.4 wt %, and the amount of coating silver therein was 35.7 wt %. The mean particle size of the silver-coated copper alloy powder was 4.7 μm. The initial volume resistivity of the silver-coated copper alloy powder was $3.5\times10^{-5}\Omega\cdot$cm. The rate of variability of the volume resistivity after being stored for 1 week was 37%, and the rate of variability of the volume resistivity after being stored for 2 weeks was 50%.

The obtained silver-coated copper alloy powder was used for preparing a conductive film by the same method as that in Example 1. With respect to the conductive film thus obtained, the calculation of the volume resistivity thereof and the evaluation of the storage stability (reliability) thereof were carried out by the same methods as those in Example 1. As a result, the volume resistivity (initial volume resistivity) of the conductive film was $11.8\times10^{-5}\Omega\cdot$cm. The rate of variability of the volume resistivity of the conductive film after being stored for 1 week was −7%, and the rate of variability of the volume resistivity of the conductive film after being stored for 2 weeks was −6%.

These results are shown in Tables 1 through 4.

EXAMPLE 10

A copper alloy powder (copper-nickel-zinc alloy powder) was obtained by the same method as that in Example 1, except that 6.4 kg of copper, 0.8 kg of nickel and 0.8 kg of zinc were used in place of 7.2 kg of copper and 0.8 kg of nickel.

With respect to the copper alloy powder thus obtained, the composition of the powder and the mean particle size thereof were derived by the same methods as those in Example 1, and the high-temperature stability thereof was evaluated by the same method as that in Example 1. Furthermore, the content of zinc in the copper alloy powder was calculated by the same method as the method for calculating the content of each of copper and nickel in the copper alloy powder in Example 1. As a result, the content of copper in the copper alloy powder was 84.5 wt %, the content of nickel therein was 10.8 wt % and the content of zinc therein was 4.3 wt %. The mean particle size of the copper alloy powder was 1.9 μm. The rate of increase of the weight of the copper alloy powder was 1.7%.

The obtained copper alloy powder (copper-nickel-zinc alloy powder) was used for preparing a copper-nickel-zinc alloy powder coated with silver (a silver-coated copper alloy powder) by the same method as that in Example 1.

With respect to the silver-coated copper alloy powder thus obtained, the composition of the powder, the amount of coating silver therein, the mean particle size thereof and the resistance of pressed powder thereof were derived by the same methods as those in Example 1, and the storage stability (reliability) of the powder was evaluated by the same method as that in Example 1. Furthermore, the content of zinc in the silver-coated copper alloy powder was calculated by the same method as the method for calculating the content of each of copper and nickel in the silver-coated copper alloy powder in Example 1. As a result, the content of copper in the silver-coated copper alloy powder was 56.0 wt %, and the content of nickel therein was 7.0 wt %. The content of zinc therein was 2.2 wt %, and the amount of coating silver therein was 34.7 wt %. The mean particle size of the silver-coated copper alloy powder was 6.1 μm. The initial volume resistivity of the silver-coated copper alloy powder was $4.0\times10^{-5}\Omega\cdot$cm. The rate of variability of the volume resistivity after being stored for 1 week was 35%, and the rate of variability of the volume resistivity after being stored for 2 weeks was 44%.

The obtained silver-coated copper alloy powder was used for preparing a conductive film by the same method as that in Example 1. With respect to the conductive film thus obtained, the calculation of the volume resistivity thereof and the evaluation of the storage stability (reliability) thereof were carried out by the same methods as those in Example 1. As a result, the volume resistivity (initial volume resistivity) of the conductive film was $8.1\times10^{-5}\Omega\cdot$cm. The rate of variability of the volume resistivity of the conductive film after being stored for 1 week was −3%, and the rate of variability of the volume resistivity of the conductive film after being stored for 2 weeks was −5%.

These results are shown in Tables 1 through 4.

EXAMPLE 11

A copper alloy powder (copper-zinc alloy powder) was obtained by the same method as that in Example 1, except that 7.6 kg of copper and 0.4 kg of zinc were used in place of 7.2 kg of copper and 0.8 kg of nickel.

With respect to the copper alloy powder thus obtained, the composition of the powder and the mean particle size thereof were derived by the same methods as those in Example 1, and the high-temperature stability thereof was evaluated by the same method as that in Example 1. Furthermore, the content of zinc in the copper alloy powder was calculated by the same method as the method for calculating the content of each of copper and nickel in the copper alloy powder in Example 1. As a result, the content of copper in the copper alloy powder was 95.5 wt %, and the content of zinc therein was 4.5 wt %. The mean particle size of the copper alloy powder was 4.7 μm. The rate of increase of the weight of the copper alloy powder was 2.4%.

Then, 61.9 g of EDTA-2Na dihydrate and 61.9 g of ammonium carbonate were dissolved in 720 g of pure water to prepare a solution (solution 1), and a solution obtained by dissolving 51.2 g of silver nitrate in 158.2 g of pure water was added to a solution, which was obtained by dissolving 307.1 g of EDTA-2Na dihydrate and 153.5 g of ammonium carbonate in 1223.2 g of pure water, to prepare a solution (solution 2).

Then, in an atmosphere of nitrogen, 130 g of the obtained copper alloy powder (copper-zinc alloy powder) was added to the solution 1, and the temperature of the solution was increased to 35° C. while the solution was stirred. After the solution 2 was added to the solution, in which the copper alloy powder (copper-zinc alloy powder) was dispersed, to be stirred for 1 hour, a solution obtained by dissolving 0.4 g of palmitic acid in 12.6 g of industrial alcohol (SOLMIX AP7 produced by Japan Alcohol Treading Co., Ltd.) was added to the stirred solution as a dispersing agent, and the solution was further stirred for 40 minutes. Thereafter, the solution was filtered, washed with water, dried and broken to obtain a copper-zinc alloy powder coated with silver (a silver-coated copper alloy powder).

With respect to the silver-coated copper alloy powder thus obtained, the composition of the powder, the amount of coating silver therein, the mean particle size thereof and the resistance of pressed powder thereof were derived by the same methods as those in Example 1, and the storage stability (reliability) of the powder was evaluated by the same method as that in Example 1. Furthermore, the content of zinc in the silver-coated copper alloy powder was calculated by the same method as the method for calculating the content of each of copper and nickel in the silver-coated copper alloy powder in Example 1. As a result, the content of copper in the silver-coated copper alloy powder was 79.9 wt %, the content of zinc therein was 3.5 wt %, and the amount of coating silver therein was 16.6 wt %. The mean particle size of the silver-coated copper alloy powder was 5.6 μm. The initial volume resistivity of the silver-coated copper alloy powder was $2.8\times10^{-5}\Omega\cdot$cm. The rate of variability of the volume resistivity after being stored for 1 week was −27%, and the rate of variability of the volume resistivity after being stored for 2 weeks was −5%. Furthermore, the percentage (silver covering rate) (area %) of the silver layer occupying the surface of the silver-coated copper alloy powder with respect to that of the whole surface thereof was calculated by the same method as that in Example 7. As a result, the percentage was 95 area %.

The obtained silver-coated copper alloy powder was used for preparing a conductive film by the same method as that in Example 1. With respect to the conductive film thus obtained, the calculation of the volume resistivity thereof and the evaluation of the storage stability (reliability) thereof were carried out by the same methods as those in Example 1. As a result, the volume resistivity (initial volume resistivity) of the conductive film was $5.1\times10^{-5}\Omega\cdot$cm. The rate of variability of the volume resistivity of the conductive film after being stored for 1 week was 2%, and the rate of variability of the volume resistivity of the conductive film after being stored for 2 weeks was 2%.

These results are shown in Tables 1 through 4.

EXAMPLE 12

First, 353.7 g of the same copper alloy powder (copper-zinc alloy powder) as that in Example 11, 2144.7 g of stainless balls having a diameter of 1.6 mm, and 136.3 g of industrial alcohol (SOLMIX AP7 produced by Japan Alcohol Treading Co., Ltd.) were put in a wet media stirring mill (having a tank volume of 1 L and a rod-shaped arm type stirring blade) to be stirred at a blade circumferential speed (blade tip speed) of 2.5 m/sec for 30 minutes. A slurry thus obtained was filtered and dried to obtain a flake-shaped copper alloy powder (a flake-shaped copper-zinc alloy powder).

With respect to the flake-shaped copper alloy powder thus obtained, the composition of the powder and the mean particle size thereof were derived by the same methods as those in Example 1, and the high-temperature stability thereof was evaluated by the same method as that in Example 1. Furthermore, the content of zinc in the flake-shaped copper alloy powder was calculated by the same method as the method for calculating the content of each of copper and nickel in the copper alloy powder in Example 1. As a result, the content of copper in the flake-shaped copper alloy powder was 95.5 wt %, and the content of zinc therein was 4.5 wt %. The mean particle size of the flake-shaped copper alloy powder was 6.1 μm. The rate of increase of the weight of the flake-shaped copper alloy powder was 2.9%.

The obtained flake-shaped copper alloy powder (copper-zinc alloy powder) was used for preparing a flake-shaped copper-zinc alloy powder coated with silver (a silver-coated flake-shaped copper alloy powder) by the same method as that in Example 11.

With respect to the silver-coated flake-shaped copper alloy powder thus obtained, the composition of the powder, the amount of coating silver therein, the mean particle size thereof and the resistance of pressed powder thereof were derived by the same methods as those in Example 1, and the storage stability (reliability) of the powder was evaluated by the same method as that in Example 1. Furthermore, the content of zinc in the silver-coated flake-shaped copper alloy powder was calculated by the same method as the method for calculating the content of each of copper and nickel in the silver-coated copper alloy powder in Example 1. As a result, the content of copper in the silver-coated flake-shaped copper alloy powder was 77.5 wt %, the content of zinc therein was 3.3 wt %, and the amount of coating silver therein was 19.2 wt %. The mean particle size of the silver-coated flake-shaped copper alloy powder was 7.2 μm. The initial volume resistivity of the silver-coated flake-shaped copper alloy powder was $3.0\times10^{-5}\Omega\cdot$cm. The rate of variability of the volume resistivity after being stored for 1 week was −16%, and the rate of variability of the volume resistivity after being stored for 2 weeks was −10%. Furthermore, the percentage (silver covering rate) (area %) of the silver layer occupying the surface of the silver-coated copper alloy powder with respect to that of the whole surface thereof was calculated by the same method as that in Example 7. As a result, the percentage was 88 area %.

Furthermore, the silver-coated flake-shaped copper alloy powder was mixed with a resin to be formed as a paste. The paste thus formed was applied on a copper plate to be dried to form a film. The side face of the film thus formed was observed at a magnifying power of 1000 by means of a field emission-scanning electron microscope (FE-SEM) (S-4700 produced by Hitachi, Ltd.). With respect to 100 particles (standing perpendicular to the observed image) of the silver-coated flake-shaped copper alloy powder, an image analyzing particle size distribution measuring software (Mac-View Ver. 4 commercially available from Mountech Co., Ltd.) was used for measuring the longest length of each of the particles to obtain an arithmetic mean of the lengths thereof as a mean long diameter L and for measuring the shortest length of each of the particles to obtain an arithmetic mean of the lengths thereof as a mean thickness T. The mean long diameter L and mean thickness T thus obtained were used for deriving (Mean Long Diameter L/Mean Thickness T) as the aspect ratio of the silver-coated flake-shaped copper alloy powder. As a result, the aspect ratio of the silver-coated flake-shaped copper alloy powder was 9.

The obtained silver-coated flake-shaped copper alloy powder was used for preparing a conductive film by the same method as that in Example 1. With respect to the conductive film thus obtained, the calculation of the volume resistivity thereof and the evaluation of the storage stability (reliability) thereof were carried out by the same methods as those in Example 1. As a result, the volume resistivity (initial volume resistivity) of the conductive film was $6.5\times10^{-5}\Omega\cdot$cm. The rate of variability of the volume resistivity of the conductive film after being stored for 1 week was 4%, and the rate of variability of the volume resistivity of the conductive film after being stored for 2 weeks was 4%.

These results are shown in Tables 1 through 4.

COMPARATIVE EXAMPLE 1

As an example of a copper alloy powder which was not coated with silver, with respect to the same copper alloy powder (copper-nickel alloy powder) as that in Example 1, the composition of the powder, the amount of coating silver therein, the mean particle size thereof and the resistance of pressed powder thereof were derived by the same methods as those in Example 1. As a result, the content of copper in the copper alloy powder was 90.1 wt %, the content of nickel therein was 9.9 wt %, and the amount of coating silver therein was 0 wt %. The mean particle size of the copper alloy powder was 1.7 μm. The initial volume resistivity of the copper alloy powder was $3.3\times10^{4}\Omega\cdot$cm.

This copper alloy powder was used for preparing a conductive film by the same method as that in Example 1. With respect to the conductive film thus obtained, the calculation of the volume resistivity thereof and the evaluation of the storage stability (reliability) thereof were carried out by the same methods as those in Example 1. As a result, the volume resistivity (initial volume resistivity) of the conductive film was $2146.1\times10^{-5}\Omega\cdot$cm, and the rate of variability of the volume resistivity of the conductive film after being stored for 1 week was 974%.

These results are shown in Tables 1 through 4.

COMPARATIVE EXAMPLE 2

The same copper alloy powder (copper-nickel alloy powder) as that in Example 1 was used for obtaining a copper-nickel alloy powder coated with silver (a silver-coated copper alloy powder) by the same method as that in Example 1, except that a solution prepared by dissolving 21.4 g of EDTA-2Na dihydrate and 21.4 g of ammonium carbonate in 249 g of pure water was used as the solution 1 and that a solution prepared by adding a solution, which was obtained by dissolving 1.45 g of silver nitrate in 4.5 g of pure water, to a solution, which was obtained by dissolving 8.68 g of EDTA-2Na dihydrate and 4.34 g of ammonium carbonate in 35 g of pure water, was used as the solution 2.

With respect to the silver-coated copper alloy powder thus obtained, the composition of the powder, the amount of coating silver therein, the mean particle size thereof and the resistance of pressed powder thereof were derived by the same methods as those in Example 1, and the storage stability (reliability) of the powder was evaluated by the same method as that in Example 1. As a result, the content of copper in the silver-coated copper alloy powder was 87.9 wt %, the content of nickel therein was 9.9 wt %, and the amount of coating silver therein was 2.2 wt %. The mean particle size of the silver-coated copper alloy powder was 1.7 μm. The initial volume resistivity of the silver-coated copper alloy powder was $70.0\times10^{-5}\Omega\cdot$cm. The rate of variability of the volume resistivity after being stored for 1 week was 419526798%, and the rate of variability of the volume resistivity after being stored for 2 weeks was 646498597%.

The obtained silver-coated copper alloy powder was used for preparing a conductive film by the same method as that in Example 1. With respect to the conductive film thus obtained, the calculation of the volume resistivity thereof and the evaluation of the storage stability (reliability) thereof were carried out by the same methods as those in Example 1. As a result, the volume resistivity (initial volume resistivity) of the conductive film was $79.5\times10^{-5}\Omega\cdot$cm. The rate of variability of the volume resistivity of the conductive film after being stored for 1 week was 8%, and the rate of variability of the volume resistivity of the conductive film after being stored for 2 weeks was 15%.

These results are shown in Tables 1 through 4.

COMPARATIVE EXAMPLE 3

The same copper alloy powder (copper-nickel alloy powder) as that in Example 1 was used for obtaining a copper-nickel alloy powder coated with silver (a silver-coated copper alloy powder) by the same method as that in Example 1, except that a solution prepared by dissolving 21.4 g of EDTA-2Na dihydrate and 21.4 g of ammonium carbonate in 249 g of pure water was used as the solution 1 and that a solution prepared by adding a solution, which was obtained by dissolving 3.73 g of silver nitrate in 11.5 g of pure water, to a solution, which was obtained by dissolving 22.4 g of EDTA-2Na dihydrate and 11.2 g of ammonium carbonate in 89 g of pure water, was used as the solution 2.

With respect to the silver-coated copper alloy powder thus obtained, the composition of the powder, the amount of coating silver therein, the mean particle size thereof and the resistance of pressed powder thereof were derived by the same methods as those in Example 1, and the storage stability (reliability) of the powder was evaluated by the same method as that in Example 1. As a result, the content of copper in the silver-coated copper alloy powder was 85.0 wt %, the content of nickel therein was 9.5 wt %, and the amount of coating silver therein was 5.5 wt %. The mean particle size of the silver-coated copper alloy powder was 1.8 μm. The initial volume resistivity of the silver-coated copper alloy powder was $18.0\times10^{-5}\Omega\cdot$cm. The rate of variability of the volume resistivity after being stored for 1 week was 179844%, and the rate of variability of the volume resistivity after being stored for 2 weeks was 318314%.

The obtained silver-coated copper alloy powder was used for preparing a conductive film by the same method as that in Example 1. With respect to the conductive film thus obtained, the calculation of the volume resistivity thereof and the evaluation of the storage stability (reliability) thereof were carried out by the same methods as those in Example 1. As a result, the volume resistivity (initial volume resistivity) of the conductive film was $26.0\times10^{-5}\Omega\cdot$cm. The rate of variability of the volume resistivity of the conductive film after being stored for 1 week was 4%, and the rate of variability of the volume resistivity of the conductive film after being stored for 2 weeks was 8%.

These results are shown in Tables 1 through 4.

COMPARATIVE EXAMPLE 4

A copper powder was obtained by the same method as that in Example 1, except that 8.0 kg of copper was used in place of 7.2 kg of copper and 0.8 kg of nickel.

With respect to the copper powder thus obtained, the mean particle size thereof was derived by the same method as that in Example 1, and the high-temperature stability thereof was evaluated by the same method as that in Example 1. As a result, the mean particle size of the copper powder was 2.0 μm, and the rate of increase of the weight of the copper powder was 8.8%.

The obtained copper powder was used for preparing a copper powder coated with silver (a silver-coated copper powder) by the same method as that in Example 1.

With respect to the silver-coated copper powder thus obtained, the composition of the powder, the amount of coating silver therein, the mean particle size thereof and the resistance of pressed powder thereof were derived by the same methods as those in Example 1, and the storage stability (reliability) of the powder was evaluated by the same method as that in Example 1. As a result, the content of copper in the silver-coated copper powder was 72.9 wt %, and the amount of coating silver therein was 27.0 wt %. The mean particle size of the silver-coated copper powder was 4.7 μm. The initial volume resistivity of the silver-coated copper powder was $2.9\times10^{-5}\Omega\cdot$cm. The rate of variability of the volume resistivity after being stored for 1 week was 912%, and the rate of variability of the volume resistivity after being stored for 2 weeks was 1709%.

The obtained silver-coated copper powder was used for preparing a conductive film by the same method as that in Example 1. With respect to the conductive film thus obtained, the calculation of the volume resistivity thereof and the evaluation of the storage stability (reliability) thereof were carried out by the same methods as those in Example 1. As a result, the volume resistivity (initial volume resistivity) of the conductive film was $13.6\times10^{-5}\Omega\cdot$cm. The rate of variability of the volume resistivity of the conductive film after being stored for 1 week was 11%, and the rate of variability of the volume resistivity of the conductive film after being stored for 2 weeks was 43%.

Figure 2A:
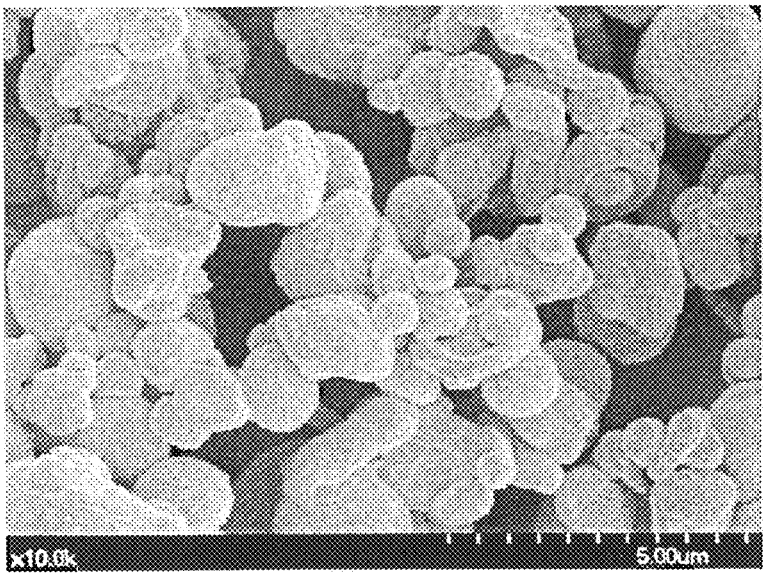
FIG. 2A is a SEM image of a silver-coated copper powder obtained in Comparative Example 4, when it is in an initial state.
Figure 2B:
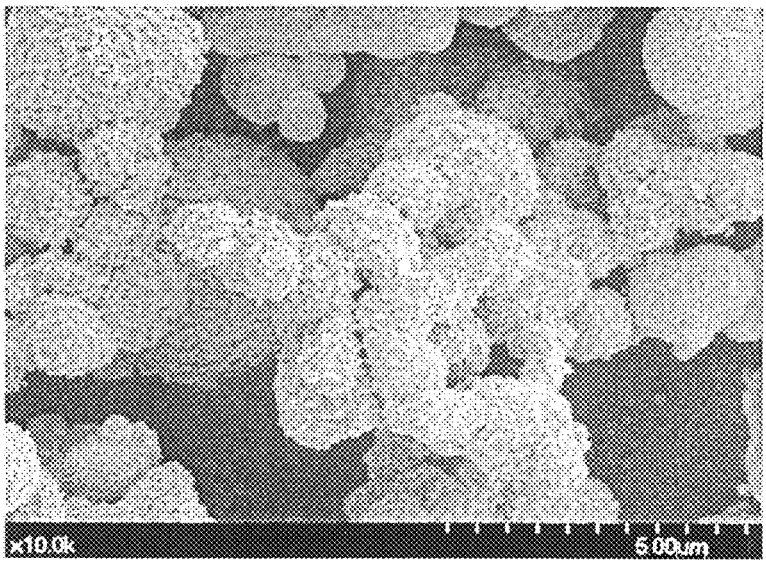
FIG. 2B is a SEM image of the silver-coated copper powder obtained in Comparative Example 4, after it is stored under an environment of a temperature 85° C. and a humidity of 85% for 1 week.

These results are shown in Tables 1 through 4. FIGS. 2A and 2B show the SEM image of the silver-coated copper powder obtained in this comparative example when it was in the initial state, and the SEM image of the silver-coated copper powder obtained in this comparative example after it was stored for 1 week, respectively.

COMPARATIVE EXAMPLE 5

With respect to a commercially available spherical copper powder (SF-Cu produced by Nippon Atomized Metal Powders Corporation) produced by an atomizing method, the mean particle size thereof was derived by the same method as that in Example 1, and the high-temperature stability thereof was evaluated by the same method as that in Example 1. As a result, the mean particle size of the copper powder was 5.7 μm, and the rate of increase of the weight of the copper powder was 3.3%.

After 120 g of the spherical copper powder was added to 2 wt % of dilute nitric acid to be stirred for 5 minutes to remove oxides on the surface of the copper powder, it was filtered and washed with water. After the spherical copper powder, from the surface of which the oxides were thus removed, was added to a solution containing 408.7 of pure water, 32.7 g of AgCN and 30.7 g of NaCN to be stirred for 60 minutes, it was filtered, washed with water and dried to obtain a copper powder coated with silver.

After 96 g of the silver-coated copper powder thus obtained and 720 g of zirconia balls having a diameter of 5 mm were put in the vessel of a ball mill (having a volume of 400 mL and a diameter of 7.5 cm), the vessel was rotated at a number of rotation of 116 rpm for 330 minutes to deform the shape of the powder to obtain a flake-shaped copper powder coated with silver (a silver-coated flake-shaped copper powder)

With respect to the silver-coated flake-shaped copper powder thus obtained, the composition of the powder, the amount of coating silver therein, the mean particle size thereof and the resistance of pressed powder thereof were derived by the same methods as those in Example 1, and the storage stability (reliability) of the powder was evaluated by the same method as that in Example 1. As a result, the content of copper in the silver-coated flake-shaped copper powder was 80.4 wt %, and the amount of coating silver therein was 19.6 wt %. The mean particle size of the silver-coated flake-shaped copper powder was 9.1 μm. The initial volume resistivity of the silver-coated flake-shaped copper powder was $8.4\times10^{-5}\Omega\cdot$cm. The rate of variability of the volume resistivity after being stored for 1 week was 38400900801%, and the rate of variability of the volume resistivity after being stored for 2 weeks was 24173914178%. Furthermore, the percentage (silver covering rate) (area %) of the silver layer occupying the surface of the silver-coated copper powder with respect to that of the whole surface thereof was calculated by the same method as that in Example 7. As a result, the percentage was 31 area %. The aspect ratio of the silver-coated flake-shaped copper powder was obtained by the same method as that in Example 12. As a result, the aspect ratio of the silver-coated flake-shaped copper powder was 7.

The obtained silver-coated flake-shaped copper powder was used for preparing a conductive film by the same method as that in Example 1. With respect to the conductive film thus obtained, the calculation of the volume resistivity thereof and the evaluation of the storage stability (reliability) thereof were carried out by the same methods as those in Example 1. As a result, the volume resistivity (initial volume resistivity) of the conductive film was $144.1\times10^{-5}\Omega\cdot$cm. The rate of variability of the volume resistivity of the conductive film after being stored for 1 week was 1%, and the rate of variability of the volume resistivity of the conductive film after being stored for 2 weeks was −4%.

These results are shown in Tables 1 through 4.

As can be seen from Tables 1 through 4, the rate of increase of the weight of the copper alloy powder used in each of Examples 1 through 12 and Comparative Examples 1 through 3 and 5 was a low rate of 5% or less when the copper alloy (or copper) powder was heated to 300° C. in the atmosphere, so that the high-temperature stability of the copper alloy (or copper) powder (against oxidation) in the atmosphere was good. However, the rate of increase of the weight of the copper powder used in Comparative Example 4 was a high rate of 8.8% when the copper powder was heated to 300° C. in the atmosphere, so that the high-temperature stability of the copper powder (against oxidation) in the atmosphere was not good.

In the case of the silver-coated copper alloy powder obtained in each of Examples 1 through 12, the initial volume resistivity of the pressed powder was a low value of $9\times10^{-5}\Omega\cdot$cm or less, and the rate of variability of the volume resistivity after being stored for 1 week was a low rate of 500% or less. However, in the case of the silver-coated copper alloy powder obtained in each of Comparative Examples 2 and 3, the initial volume resistivity of the pressed powder was very high, and the rate of variability of the volume resistivity after being stored for 1 week was very high. In the case of the silver-coated copper powder obtained in each of Comparative Example 4 and 5, the rate of variability of the volume resistivity after being stored for 1 week was very high although the initial volume resistivity of the pressed powder was low.

In the case of the conductive film obtained from the electrically conductive paste using the silver-coated copper alloy powder obtained in each of Examples 1 through 12, the initial volume resistivity was a low value of $16\times10^{-5}\Omega\cdot$cm or less, and the rate of variability of the volume resistivity after being stored for 1 week was a low value of −8% to −4%. However, in the case of the conductive film obtained from the electrically conductive paste using the silver-coated copper alloy (or copper) powder obtained in each of Comparative Examples 1 through 3 and 5, the initial volume resistivity was high, and the volume resistivity after being stored for 1 week was also high.

As can be seen from FIGS. 1A and 1B, the smoothness of the surface of the silver-coated copper alloy powder obtained in Example 8 was held even after it was stored for 1 week. However, the smoothness of the surface of the silver-coated copper powder obtained in Comparative Example 4 was not held after it was stored for 1 week. Thus, the storage stability of the silver-coated copper alloy powder obtained in Example 8 was superior to that in Comparative Example 4.

It can be seen from these results that the silver-coated copper alloy powder obtained in each of Example 1 through 12 has a low volume resistivity and excellent storage stability (reliability).

Furthermore, as reference examples, a silver-coated copper alloy powder produced by coating an alloy powder of 70 wt % of copper and 30 wt % of tin with 10 wt % of silver, and a silver-coated copper alloy powder produced by coating an alloy powder of 90 wt % of copper and 10 wt % of aluminum with 30 wt % of silver were observed by SEM images. As a result, it was found that the surface of each of the silver-coated copper alloy powders was not smooth even in the initial state thereof to have a patchy pattern (mottled effect). Since it was confirmed from the composition analysis thereof that silver exists on each of these alloy powders, it was found that silver coating the surface of the particles of each of the alloy powders exists in a patchy pattern.

The invention claimed is:

1. A silver-coated copper alloy powder comprising:

a copper alloy powder having a chemical composition comprising 1 to 50 wt % of nickel and zinc and the balance being copper and unavoidable impurities; and 7 to 50 wt % of a silver containing layer coating the copper alloy powder, wherein the silver-coated copper alloy powder has a volume resistivity, which is not higher than 500% of an initial volume resistivity thereof, when a load of 20 kN is applied to said silver-coated copper alloy powder after it is stored under an environment of a temperature of 85° C. and a humidity of 85% for 1 week.

2. A silver-coated copper alloy powder as set forth in claim 1, wherein said silver containing layer is a layer of silver or a silver compound.

3. A silver-coated copper alloy powder as set forth in claim 1, wherein a particle diameter ($D_{50}$ diameter) corresponding to 50% of accumulation in cumulative distribution of said copper alloy powder, which is measured by a laser diffraction particle size analyzer, is 0.1 to 15 μm.

4. A silver-coated copper alloy powder as set forth in claim 1, wherein the rate of increase of weight of said copper alloy powder is not greater than 5% when the temperature of said copper alloy powder is increased at a rate of temperature increase of 5° C./min. from room temperature (25° C.) to 300° C.

5. A silver-coated copper alloy powder as set forth in claim 1, wherein said silver containing layer is a layer of silver, and a percentage of the silver containing layer occupying the surface of said silver-coated copper alloy powder with respect to the whole surface thereof is not less than 70 area %, the percentage being calculated from results obtained by quantifying atoms on the outermost surface of said silver-coated copper alloy powder by a scanning Auger electron spectrometer.

6. An electrically conductive paste comprising:

a solvent;

a resin; and a silver-coated copper alloy powder as set forth in claim 1 as an electrically conductive powder.

7. An electrically conductive film which is formed by curing an electrically conductive paste as set forth in claim 6.

8. A method for producing a silver-coated copper alloy powder, said method comprising the steps of:

preparing a copper alloy powder having a chemical composition comprising 1 to 50 wt % of nickel and zinc and the balance being copper and unavoidable impurities; and depositing silver or a silver compound on the surface of the copper alloy powder in a solution containing the copper alloy powder, the silver or silver compound and a chelating agent to coat the copper alloy powder with 7 to 50 wt % of a silver containing layer which is a layer of the silver or silver compound.

9. A method for producing a silver-coated copper alloy powder as set forth in claim 8, wherein said copper alloy powder is produced by an atomizing method.

10. A method for producing a silver-coated copper alloy powder as set forth in claim 8, wherein a particle diameter ($D_{50}$ diameter) corresponding to 50% of accumulation in cumulative distribution of said copper alloy powder, which is measured by a laser diffraction particle size analyzer, is 0.1 to 15 μm.

11. A method for producing a silver-coated copper alloy powder as set forth in claim 8, wherein said chelating agent is selected from the group consisting of ethylene-diamine-tetraacetic acid (EDTA), iminodiacetic acid, diethylene-triamine, triethylene-diamine, and salts thereof.

12. A method for producing a silver-coated copper alloy powder as set forth in claim 8, wherein said solution contains a buffer for pH.

13. A method for producing a silver-coated copper alloy powder as set forth in claim 12, wherein said buffer for pH is ammonium carbonate, ammonium hydrogen carbonate, ammonia water or sodium hydrogen carbonate.

14. A method for producing a silver-coated copper alloy powder as set forth in claim 8, wherein said solution has a solvent which is water, an organic solvent or a mixed solvent thereof.

15. A method for producing a silver-coated copper alloy powder as set forth in claim 8, wherein said silver compound is silver nitrate.

16. A silver-coated copper alloy powder comprising:

a copper alloy powder having a chemical composition comprising 1 to 4.7 wt % of zinc and the balance being copper and unavoidable impurities; and 7 to 50 wt % of a silver containing layer coating the copper alloy powder, wherein the silver-coated copper alloy powder has a volume resistivity, which is not higher than 500% of an initial volume resistivity thereof, when a load of 20 kN is applied to said silver-coated copper alloy powder after it is stored under an environment of a temperature of 85° C. and a humidity of 85% for 1 week.

17. A silver-coated copper alloy powder as set forth in claim 16, wherein said silver containing layer is a layer of silver or a silver compound.

18. A silver-coated copper alloy powder as set forth in claim 16, wherein a particle diameter ($D_{50}$ diameter) corresponding to 50% of accumulation in cumulative distribution of said copper alloy powder, which is measured by a laser diffraction particle size analyzer, is 0.1 to 15 μm.

19. A silver-coated copper alloy powder as set forth in claim 16, wherein the rate of increase of weight of said copper alloy powder is not greater than 5% when the temperature of said copper alloy powder is increased at a rate of temperature increase of 5° C./min. from room temperature (25° C.) to 300° C.

20. A silver-coated copper alloy powder as set forth in claim 16, wherein said silver containing layer is a layer of silver, and a percentage of the silver containing layer occupying the surface of said silver-coated copper alloy powder with respect to the whole surface thereof is not less than 70 area %, the percentage being calculated from results obtained by quantifying atoms on the outermost surface of said silver-coated copper alloy powder by a scanning Auger electron spectrometer.

21. An electrically conductive paste comprising:

a solvent;

a resin; and a silver-coated copper alloy powder as set forth in claim 16 as an electrically conductive powder.

22. An electrically conductive film which is formed by curing an electrically conductive paste as set forth in claim 21.

23. A method for producing a silver-coated copper alloy powder, said method comprising the steps of:

preparing a copper alloy powder having a chemical composition comprising 1 to 4.7 wt % of zinc and the balance being copper and unavoidable impurities; and depositing silver or a silver compound on the surface of the copper alloy powder in a solution containing the copper alloy powder, the silver or silver compound and a chelating agent to coat the copper alloy powder with 7 to 50 wt % of a silver containing layer which is a layer of the silver or silver compound.

24. A method for producing a silver-coated copper alloy powder as set forth in claim 23, wherein said copper alloy powder is produced by an atomizing method.

25. A method for producing a silver-coated copper alloy powder as set forth in claim 23, wherein a particle diameter ($D_{50}$ diameter) corresponding to 50% of accumulation in cumulative distribution of said copper alloy powder, which is measured by a laser diffraction particle size analyzer, is 0.1 to 15 μm.

26. A method for producing a silver-coated copper alloy powder as set forth in claim 23, wherein said chelating agent is selected from the group consisting of ethylene-diamine-tetraacetic acid (EDTA), iminodiacetic acid, diethylene-triamine, triethylene-diamine, and salts thereof.

27. A method for producing a silver-coated copper alloy powder as set forth in claim 23, wherein said solution contains a buffer for pH.

28. A method for producing a silver-coated copper alloy powder as set forth in claim 27, wherein said buffer for pH is ammonium carbonate, ammonium hydrogen carbonate, ammonia water or sodium hydrogen carbonate.

29. A method for producing a silver-coated copper alloy powder as set forth in claim 23, wherein said solution has a solvent which is water, an organic solvent or a mixed solvent thereof.

30. A method for producing a silver-coated copper alloy powder as set forth in claim 23, wherein said silver compound is silver nitrate.

* * * * *